US010030953B2

(12) United States Patent
Adams

(10) Patent No.: US 10,030,953 B2
(45) Date of Patent: Jul. 24, 2018

(54) ILLUMINATION MUNITION

(71) Applicant: BAE SYSTEMS plc, London (GB)

(72) Inventor: Daniel Alexander Adams, Monmouthshire (GB)

(73) Assignee: BAE SYSTEMS plc, London (GB)

( * ) Notice: Subject to any disclaimer, the term of this patent is extended or adjusted under 35 U.S.C. 154(b) by 126 days.

(21) Appl. No.: 14/913,079

(22) PCT Filed: Aug. 18, 2014

(86) PCT No.: PCT/GB2014/052530
§ 371 (c)(1),
(2) Date: Feb. 19, 2016

(87) PCT Pub. No.: WO2015/025145
PCT Pub. Date: Feb. 26, 2015

(65) Prior Publication Data

US 2016/0209189 A1 Jul. 21, 2016

(30) Foreign Application Priority Data

Aug. 20, 2013 (EP) ..... 13275187
Aug. 20, 2013 (GB) ..... 1314865.5

(51) Int. Cl.
*F42B 12/62* (2006.01)
*F42B 12/42* (2006.01)
*F42B 4/28* (2006.01)

(52) U.S. Cl.
CPC ..... *F42B 12/42* (2013.01); *F42B 4/28* (2013.01)

(58) Field of Classification Search
USPC ..... 102/342, 343, 499
See application file for complete search history.

(56) References Cited

U.S. PATENT DOCUMENTS 2,421,859 A 6/1947 Whitney
2,943,572 A 7/1960 Flett
(Continued)

FOREIGN PATENT DOCUMENTS

DE 1913790 A1 10/1970
DE 3206497 A1 11/1982
(Continued)

OTHER PUBLICATIONS

International Preliminary Report on Patentability received for Patent Application No. PCT/GB2014/052530, dated Mar. 3, 2016. 7 pages.

(Continued)

*Primary Examiner* — John W Eldred
(74) *Attorney, Agent, or Firm* — Finch & Maloney PLLC

(57) ABSTRACT

The invention relates to an illumination munition, particularly an illumination payload ejection device housed within a common carrier payload delivery shell, with a frangible safety link.

There is provided an illumination munition comprising a shearable tail unit, a main body which comprises a payload cavity for receiving an illumination payload apparatus, a fuze, an ogive element located between said main body and the fuze, and an explosive train operably connected to said fuze, wherein the illumination payload apparatus comprises an illumination composition, a drogue parachute and a main parachute, wherein the main parachute is tethered by a payload tether to the payload apparatus, such that after deployment of said main parachute said payload apparatus descends under the control of said main parachute.

20 Claims, 4 Drawing Sheets

(56) References Cited

U.S. PATENT DOCUMENTS

| | | | |
|---|---|---|---|
| 3,055,300 | A | 9/1962 | Stoeher |
| 3,677,182 | A | 7/1972 | Peterson |
| 3,750,575 | A | 8/1973 | Heede et al. |
| 3,834,312 | A | 9/1974 | Simmons |
| 3,842,741 | A | 10/1974 | Brothers et al. |
| 3,981,244 | A | 9/1976 | Adimari et al. |
| 4,226,185 | A | 10/1980 | Tobler et al. |
| 4,557,198 | A | 12/1985 | Hickey |
| 4,651,648 | A | 3/1987 | Alon |
| 4,771,696 | A | 9/1988 | Smolnik |
| 4,793,260 | A | 12/1988 | Kruse et al. |
| 4,807,533 | A | 2/1989 | von Entress-Fursteneck |
| 4,833,993 | A | 5/1989 | Garcia-Garcia |
| 4,860,659 | A | 8/1989 | Andreetta |
| H0000959 | H | 9/1991 | Heckman et al. |
| 5,107,768 | A | 4/1992 | Langenohl |
| 5,210,372 | A | 5/1993 | Tripptrap et al. |
| 5,233,127 | A | 8/1993 | Sauvestre et al. |
| 5,317,975 | A | 6/1994 | Sauvestre et al. |
| 5,347,931 | A | 9/1994 | Day |
| 5,386,781 | A | 2/1995 | Day |
| 5,454,324 | A | 10/1995 | Larmignat et al. |
| 5,684,267 | A | 11/1997 | Dean |
| 5,792,981 | A | 8/1998 | Singer et al. |
| 6,523,478 | B1 | 2/2003 | Gonzalez et al. |
| 6,679,177 | B1 | 1/2004 | Wu et al. |
| 6,782,829 | B1 | 8/2004 | Han et al. |
| 6,860,185 | B2 | 3/2005 | Altenau |
| 6,981,450 | B1 | 1/2006 | Adimari |
| 7,121,210 | B2 | 10/2006 | Steele |
| 7,124,690 | B1 | 10/2006 | Tadros et al. |
| 7,360,489 | B1 | 4/2008 | Han et al. |
| 8,601,950 | B2 | 12/2013 | Dau et al. |
| 2002/0166475 | A1 | 11/2002 | Brooks et al. |
| 2003/0116051 | A1 | 6/2003 | Kravel et al. |
| 2003/0205161 | A1 | 11/2003 | Roach |
| 2004/0107860 | A1 | 6/2004 | Loubser |
| 2004/0134372 | A1 | 7/2004 | Scherer et al. |
| 2005/0066842 | A1 | 3/2005 | Brunn et al. |
| 2005/0223930 | A1 | 10/2005 | Bootes et al. |
| 2007/0006767 | A1 | 1/2007 | Brislin et al. |
| 2009/0151590 | A1 | 6/2009 | Dau et al. |
| 2011/0079164 | A1 | 4/2011 | Broden et al. |
| 2012/0044710 | A1 | 2/2012 | Jones |
| 2012/0180686 | A1 | 7/2012 | Jones et al. |
| 2013/0055917 | A1 | 3/2013 | Menefee, III |
| 2013/0186295 | A1 | 7/2013 | Kravel |
| 2013/0239838 | A1 | 9/2013 | Kravel |
| 2013/0319278 | A1 | 12/2013 | Kravel |
| 2014/0013985 | A1 | 1/2014 | Kravel |
| 2016/0202031 | A1 | 7/2016 | Rumfitt et al. |
| 2016/0209189 | A1 | 7/2016 | Adams |
| 2016/0209190 | A1 | 7/2016 | Jones |
| 2016/0209191 | A1 | 7/2016 | Adams et al. |

FOREIGN PATENT DOCUMENTS

| | | | |
|---|---|---|---|
| DE | 3339039 | A1 | 5/1985 |
| DE | 102007048074 | A1 | 4/2009 |
| EP | 0466499 | A1 | 1/1992 |
| FR | 1398715 | A | 5/1965 |
| FR | 2697328 | A1 | 4/1994 |
| FR | 2699659 | A1 | 6/1994 |
| GB | 143281 | A | 5/1920 |
| GB | 1179804 | A | 2/1970 |
| GB | 1415274 | | 11/1975 |
| GB | 2105813 | A | 3/1983 |
| GB | 2274905 | A | 8/1994 |
| JP | 2011047527 | A | 3/2011 |
| WO | 2015025141 | A1 | 2/2015 |
| WO | 2015025143 | A1 | 2/2015 |
| WO | 2015025144 | A1 | 2/2015 |
| WO | 2015025145 | A1 | 2/2015 |

OTHER PUBLICATIONS

International Preliminary Report on Patentability received for Patent Application No. PCT/GB2014/052526, dated Mar. 3, 2016. 7 pages.

International Preliminary Report on Patentability received for Patent Application No. PCT/GB2014/052528, dated Mar. 3, 2016. 7 pages.

International Preliminary Report on Patentability received for Patent Application No. PCT/GB2014/052529 dated Mar. 3, 2016. 7 pages.

International Search Report and Written Opinion received for Patent Application No. PCT/GB2014/052528, dated Sep. 17, 2014. 11 pages.

GB Intellectual Property Office Search Report under Section 17(5) received for GB Patent Application No. 1314868.9 dated Dec. 20, 2013. 4 pages.

Extended European Search Report received for EP Patent Application No. 13275190.0 dated Jan. 31, 2014. 7 pages.

International Search Report and Written Opinion received for Patent Application No. PCT/GB2014/052526, dated Sep. 17, 2014. 11 pages.

GB Intellectual Property Office Search Report under Section 17(5) received for GB Patent Application No. 1314869.7 dated Dec. 13, 2013. 6 pages.

Extended European Search Report received for EP Patent Application No. 13275188.4 dated Feb. 4, 2014. 7 pages.

GB Intellectual Property Office Search Report under Section 17(6) received for GB Patent Application No. 1314869.7 (as it relates to claim 14) dated Jun. 13, 2014. 3 pages.

International Search Report and Written Opinion received for Patent Application No. PCT/GB2014/052529, dated Sep. 17, 2014. 11 pages.

GB Intellectual Property Office Search Report under Section 17(5) received for GB Patent Application No. 1314867.1 dated Dec. 20, 2013. 4 pages.

Extended European Search Report received for EP Patent Application No. 13275189.2 dated Feb. 7, 2014. 6 pages.

International Search Report and Written Opinion received for Patent Application No. PCT/GB2014/052530, dated Sep. 17, 2014. 11 pages.

GB Intellectual Property Office Search Report under Section 17(5) received for GB Patent Application No. 1314865.5 dated Dec. 20, 2013. 4 pages.

Extended European Search Report received for EP Patent Application No. 13275187.6 dated Jan. 29, 2014. 5 pages.

ILLUMINATION MUNITION

The invention relates to an illumination munition, particularly an illumination payload ejection device housed within a common carrier payload delivery shell, with a frangible safety link.

There is a requirement to provide munitions that are Insensitive Munition (IM) compliant such that they undergo a low order event in response to a hazard event. There is also a desire that in the event of a blind, such as where a munition lands without functioning, that the munition fails in a safe mode.

Launched illumination (ilium) munitions, such as illumination shells, typically comprise an illumination composition in a pressed or consolidated form tethered to a main parachute. The illumination composition and main parachute are housed in a deployment container whose descent and spin rate are slowed by deployment of a drogue parachute. The deployment container is jettisoned to save mass, after the illumination composition is ignited and main parachute have been deployed. This results in a 4 kg to 5 kg deployment container dropping to the ground, either at or around the point of the descent of the suspended illumination composition, thereby potentially causing collateral damage at the site of the illumination.

According to a first aspect of the invention there is provided An illumination munition comprising a shearable tail unit, a main body which comprises a payload cavity for receiving an illumination payload apparatus, a fuze, an ogive element located between said main body and the fuze, an explosive train operably connected to said fuze, wherein the illumination payload apparatus comprises an illumination composition, a drogue parachute and a main parachute, wherein the main parachute is tethered by a tether arrangement to the payload apparatus, such that after deployment of said main parachute said payload apparatus descends under the control of said main parachute.

The payload apparatus tethered by a tether arrangement which comprises a payload tether to the main parachute such that the payload is lowered to the ground under the action of the main parachute, such as to mitigate against collateral damage to the area which is being illuminated.

The expulsion charge is caused to function by the fuze, the activated expulsion charge provides a large volume of gas which causes failure of the shearable tail unit and starts to push the illumination payload apparatus out of the payload cavity. The drogue parachute may be tethered by a drogue tether to the shearable tail unit, such that ejection of the tail unit applies tension on the drogue tether which causes deployment of the drogue parachute.

The drogue parachute may be tethered by a carrier tether to both a main parachute carrier and extends therethrough to a parachute delay device, wherein said main parachute carrier comprises said main parachute therein.

The parachute delay device may comprise a tether arrangement which may comprise a payload tether for connecting payload apparatus to the main parachute, a releasable engagement device to releasably receive the carrier tether, an activator which is tethered by an activator tether, wherein said activator tether may be operably linked to the drogue tether, wherein upon activation of said activator causes release of the drogue tether.

The activator tether may either be shorter in length than the drogue tether, or already be under tension, such that when the main parachute carrier is pulled out of the payload apparatus, under action of the drogue parachute, the activator tether may impart tension on the activator to allow release from the releasable engagement device. The activator may be a simple pin arrangement which holds the drogue tether in the releasable engagement device.

The primary role of the drogue parachute is to slow the velocity of the ejected payload apparatus. The second function is to cause deployment of the main parachute, which removes the need for a further energetic device to deploy the main parachute.

The drogue parachute may be tethered by a carrier tether to both the main parachute carrier and the parachute delay device, such that when the carrier tether is released from the parachute delay device it still remains attached to the main parachute carrier, and hence removes said main parachute carrier from around the main parachute, thereby releasing the main parachute. In this manner the only tether that remains attached to the payload apparatus is the payload tether which connects to the main parachute.

The main parachute comprises a plurality of parachute lines which are linked and connected by the payload tether to the payload apparatus or more preferably the parachute delay device, which is located inside said payload apparatus.

The expulsion charge whilst ejecting the payload apparatus simultaneously causes ignition of an illumination delay igniter which is operably linked to the illumination composition.

In a highly preferred arrangement the main parachute is a closed arm cruciform parachute.

The illumination composition may be at least one consolidated pellet of illumination composition. The selection of the illumination composition will be dependent on the required Lumen output, burn time, and colour.

The provision of a common carrier shell allows a selection of payloads to be introduced, preferably the payload cavity has substantially parallel walls, which extend from the intersection of the tail unit to the locking ring.

In a highly preferred arrangement the main body comprises a first threaded portion manufactured from a first material, and the tail unit comprises a second threaded portion manufactured from second material, wherein the second material has a lower hardness value than the first material; more preferably the first material is selected from a steel alloy and the second material is selected from aluminium or alloy thereof. The tail unit including the thread may be made from aluminium such that when the explosive train is initiated, which may be operably connected to an expulsion charge, causes the tail unit thread to fail and shear.

In a further arrangement the illumination munition is a frangible munition comprising a tail unit, a main body which comprises a payload cavity for receiving a illumination payload apparatus, a fuze, and an explosive train operably connected to said fuze, located between said main body and the fuze, is a frangible ogive element, wherein the frangible ogive element and main body are retained in operable engagement by at least one frangible link, such that upon an impact, said frangible link is caused to fail; such that in the event of a blind and upon impact with the ground, said frangible link fails so as to allow venting of any pressure from any energetic events.

The frangible link may be any connection means, connector or fixing, which operably links the frangible ogive element to the main body, such that the munition is able to function in the intended designed mode, but which is severable or shearable upon application of a substantial force.

The frangible link may, such as, for example be a further shearable thread or at least one shear pin which retains said main body and frangible ogive element in an operable engagement.

The further shearable thread allows the frangible ogive element to be reversibly operably engaged with the main body. The frangible ogive element and main body may comprise cooperatively engaging male and female threaded portions, wherein at least one of the threads is a shearable thread. The use of a shearable thread allows the frangible ogive element to be readily fitted and removed without damaging the shearable linkage.

The main body threaded portion may be manufactured from a first material, and the ogive threaded portion may be manufactured from second material, wherein the second material has a lower hardness value than the first material, such that upon an applied force, such as, for example impact with the ground after a blind, the lower hardness material readily undergoes plastic deformation such that the frangible ogive element disengages from the main body.

In a highly preferred arrangement the first material is selected from a steel alloy and the second material is selected from aluminium or alloy thereof. For gun launched munitions, such as for examples shells, the forces experienced during launch will place the shell under uniform compression, however impact with the ground, typically at an incident angle will place the frangible ogive element and main body under a tensile load or shearing load, forcing said frangible link to fail, hence allowing venting of any gaseous outputs, the failure of the link may substantial damage of the frangible link or even detachment of the frangible ogive element and the main body. The extent of the failure is such at if the explosive train or expulsion charge where to function that the output may be unconfined i.e. vented, and reduce the severity of the event. The extent of any energetic material event may be reduced such that there is a reduced pressure build up and may not cause the primary payload to be ejected from the shell, or may not cause the primary payload to function.

The illumination payload apparatus and payload cavity are selected such that they are preferably of a uniform dimension, such that any payload may be readily inserted into the uniform payload cavity of the munition. In a preferred arrangement the payload is a modular unit. This allows flexibility on logistics, that any payload may be inserted into any available carrier munition or shell. Conventional smoke and illumination payloads have bespoke shells or munitions and there is no interchangeability between munitions.

The illumination payload apparatus may be inserted into the payload cavity from the aft end of the munition. The illumination payload apparatus may be slidably engaged with the payload cavity, such as for example it may have an engineering fit with payload cavity, such that the illumination payload apparatus may be prevented from moving within a direction which is normal to the longitudinal i.e. elongate axis of the munition. The payload cavity may have substantially parallel walls, which extend from the intersection of main body and tail unit up to the locking ring. To prevent movement of the illumination payload apparatus within the cavity along the elongate axis of the munition, a locking ring may be located between the main body and said frangible ogive element, to retain said illumination payload apparatus within the payload cavity and prevent movement. Preferably the locking ring and main body comprise cooperatively engaging threaded portions, to allow reversible locking engagement. This allows the locking ring to compensate for any tolerances in manufacture of the illumination payload apparatus, to ensure that the illumination payload apparatus is retained in position.

The shearable thread on the tail unit allows the illumination payload apparatus to be reversibly loaded from the aft of the main body. Prior art shells secure the tail unit to the main body with shearable pins, which irreversibly fasten the tail unit to the main body, such that once the munition is constructed the tail unit may only be removed by action of the device or by applying substantial force, to cause shearing of the pins. The use of a shearable thread allows the tail unit to be readily fitted via facile low cost manufacturing methods, compared to when employing the use of shearable pins.

In a preferred arrangement the illumination payload apparatus is reversibly loadable from the aft end of the main body. The provision of a threaded tail unit allows the payload to be loaded and removed from the aft end. In a highly preferred arrangement during use the payload is capable of being dispensed rearwardly from the main body, upon shearing the shearable thread.

The frangible ogive element is a portion of the munition, typically a shell body, and may be reversibly operably engaged with the fuze and main body. Preferably the tail unit, main body frangible and ogive element are secured together by shearable threads and further shearable threads, respectively.

The frangible ogive element may have a forward end locatable with said fuze and an aft end locatable with said main body, wherein the internal diameter of the aft end of said frangible ogive element may be substantially the same as the internal diameter of said payload cavity.

The fuze may be any known fuze, such as those that respond to selected input or stimuli or a combination of inputs, such as, for example, mechanical actions of the projectile, such as the action of high g forces from gun launch or high spin rates from imparted spin, timed delay, either mechanical or pyrotechnic, caused by separation from the launch system, or proximity to a target. The energetic output of the fuze may be carefully balanced with the expulsion charge, to ensure consistent, reliable and suitable ignition of the expulsion charge. The fuze may function due to electronic activation, such as, for example, from an input from a sensor or detector from on-board said munition or external to the munition. On-board systems may be internal guidance systems. External stimuli may be provided by, remote control, GPS or target activated laser guidance. The fuze may be operably connected to an explosive train, to provide an energetic output, such as an expulsion. Where the payload is delivered during flight i.e. rather than a terminal effect, the payload may be expelled from the munition by an expulsion charge. In preferred arrangement said expulsion charge is suspended in free space, such that it does not physically contact the illumination payload apparatus; this allows for manufacturing tolerances between the expulsion charge and the illumination payload apparatus. The fuze device may comprise safety and arming units (SAU), energetic trains to provide sufficient stimuli to the expulsion charge.

Where both the, main body and tail unit and the frangible ogive element and main body are fastened with shearable threaded portions and further shearable threaded portions, respectively, the shearable threaded portion has a lower shear strength than the further shearable thread, such that during the intended use of the munition the shearable thread between the tail unit and main body fails first, so as to permit the expulsion of the charge from the aft of the main body.

According to a further aspect of the invention there is provided a method of dispensing a payload from a munition as defined herein, comprising the steps of causing initiation of the expulsion charge, causing shearing of the shearable thread.

According to a yet further aspect of the invention there is provided a method of dispensing an illumination payload apparatus from a munition as defined herein, comprising the steps of causing initiation of the expulsion charge, which causes ignition of illumination delay igniter and shearing of the shearable thread, such that said apparatus which is tethered to said shearable tail unit is caused to be pushed rearwardly from said shell, to disperse said illumination payload.

Whilst the invention has been described above, it extends to any inventive combination of the features set out above, or in the following description, drawings or claims.

Exemplary embodiments of the device in accordance with the invention will now be described with reference to the accompanying drawings in which:—

Figure 5A:
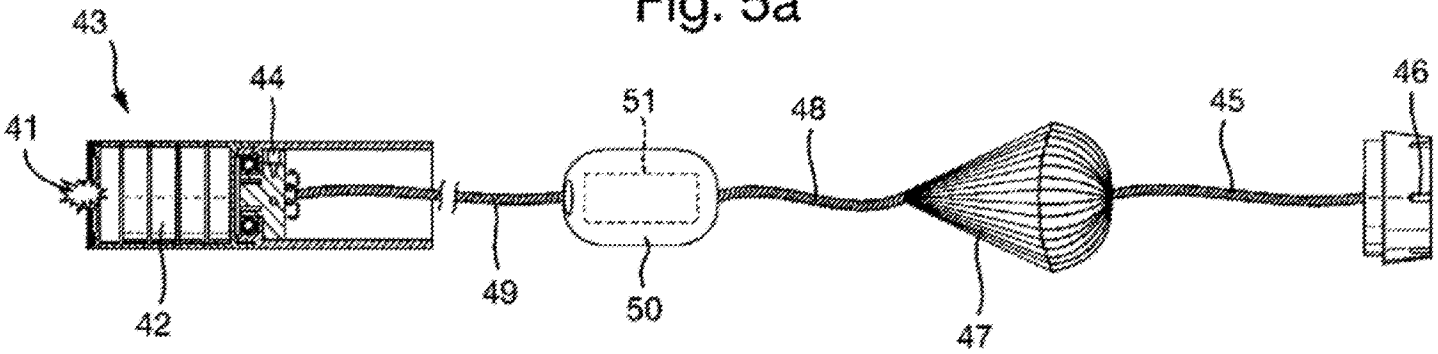
Figure 5B:
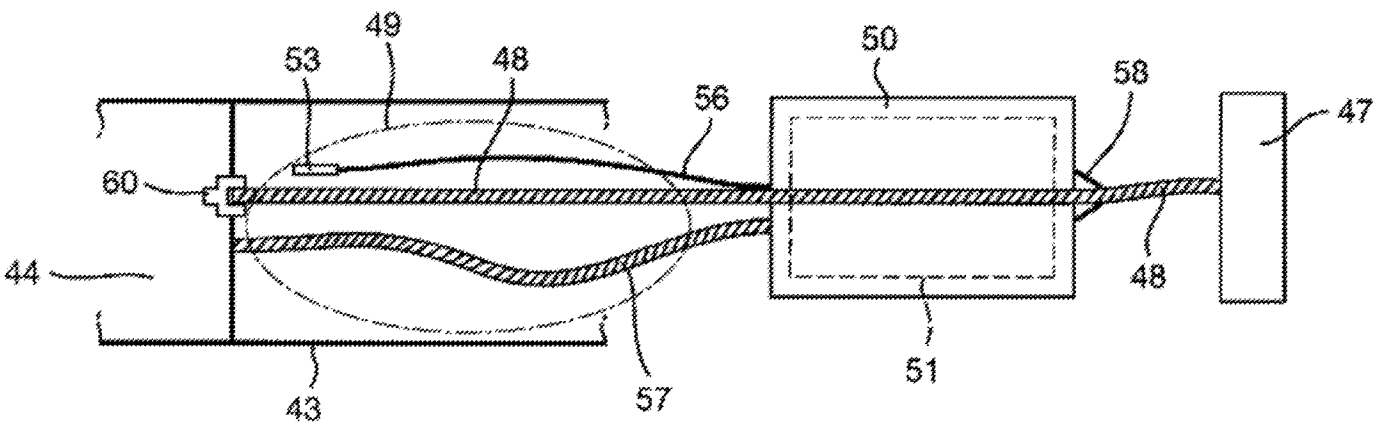

FIGS. 5*a* and 5*b* show a deployment sequence of the drogue parachute.

Figure 6:
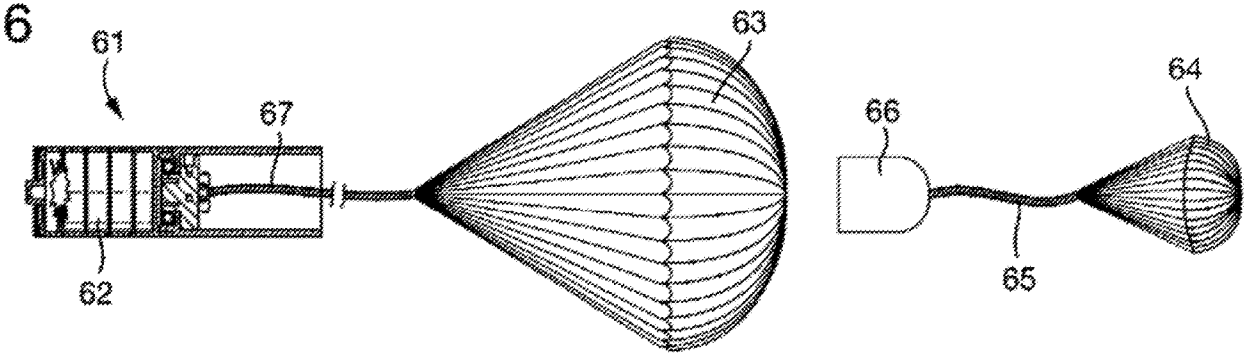

FIG. 6 shows the release sequence of the main parachute.

Figure 7:
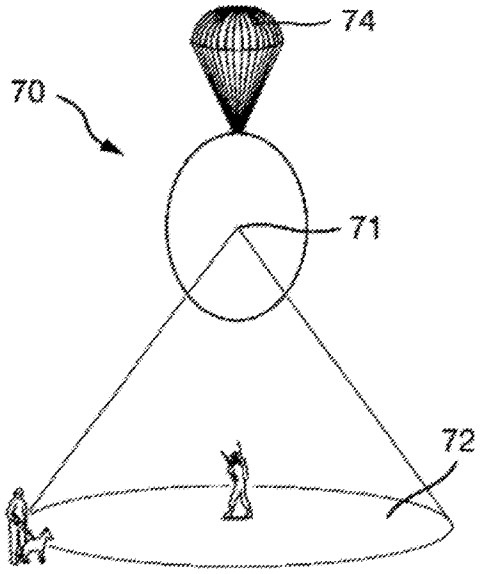

FIG. 7 shows the deployed and activated illumination composition.

Figure 1:
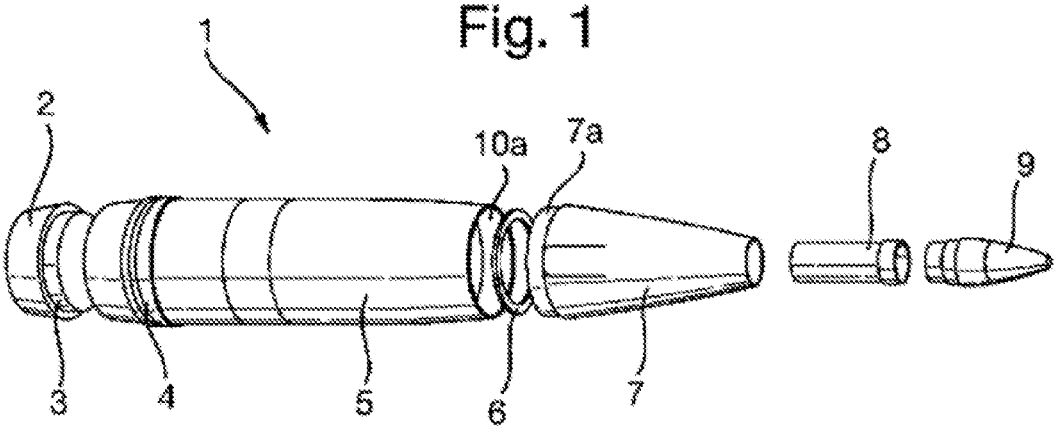
FIG. 1 shows an exploded side view of a shell.

Turing to FIG. 1 there is provided a shell 1, with a main body 5, which is manufactured from a steel alloy. Located around the circumference of the main body 5 is a copper driving band 4, which allows engagement with the rifling on the bore of a barrel, so as to impart spin. A tail unit 2 is located at the aft of the main body 5. The tail unit 2 is made from aluminium and contains a male threaded portion 3, which engages with a reciprocal female threaded portion (not shown) located in the aft of the main body 5. The illumination payload apparatus 10 (see FIG. 2), when located in the payload cavity 10*a*, inside the main body, is retained in place by use of a locking ring 6, which screws into the forward end of main body 5. The frangible ogive element 7 has a frangible link 7*a*, in the form of an aluminium thread. The frangible ogive element 7 may be secured to the locking ring 6 or directly to the main body 5. The frangible ogive element receives the expulsion charge 8 and fuze 9. Upon operation of the fuze 9, the expulsion charge 8 builds up pressure within the frangible ogive element and at the bursting pressure the thread 3 shears and the illumination payload apparatus 10 is expelled from the aft of the main body 5. During a blind event, the shell 1 would not function as detailed above, and would hit the ground, wherein the frangible link 7*a* would be caused to fail, such that if fuze 9 did erroneously function, that the expulsion charge 8 would be at least partially vented and would not cause the illumination payload apparatus 10 to be expelled from the shell 1.

Figure 2:
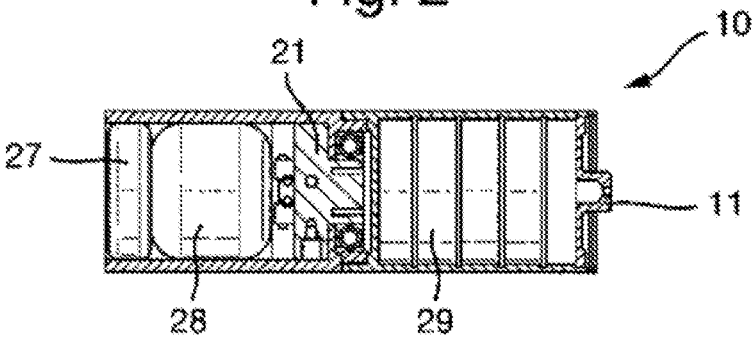
FIG. 2 shows a cross section of the illumination payload apparatus.

FIG. 2 shows the illumination payload assembly 10, with a delay igniter 11 which is ignited by the expulsion charge 8 (see FIG. 1), the delay igniter after a delayed time period ignites the illumination composition 29. When the payload 10 is ejected the drogue parachute 27 functions and the parachute delay device 21 causes the main parachute 28 to be deployed as shown in more detail in FIGS. 5*a* and 5*b*.

Figure 3:
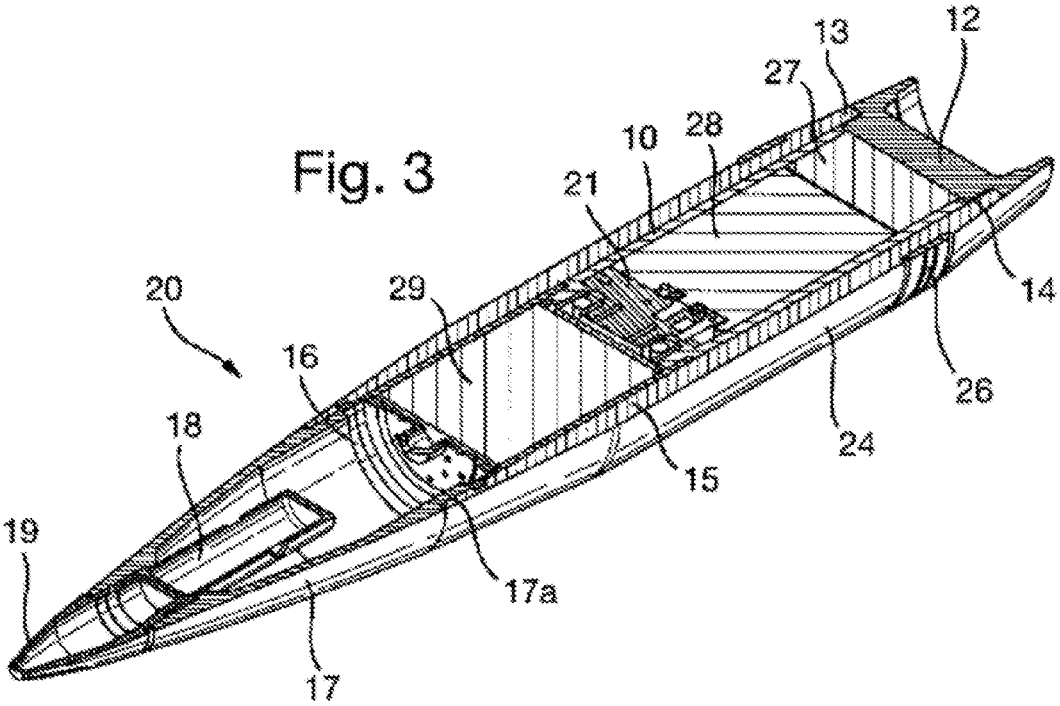
FIG. 3 shows a cross section along the axis of the shell in FIG. 1.

FIG. 3 shows an illumination shell 20, with a main body 24 formed from a steel alloy, with a driving band 26 located thereupon. A tail unit 12 is located at the aft of the main body 24. The tail unit 12 is made from aluminium and contains a male threaded portion 13, which engages with a reciprocal female threaded portion 14 located at the aft of the main body 24.

The illumination payload apparatus 10 is located in the payload cavity 15, and is retained in place by use of a locking ring 16, which screws into the forward end of main body 24.

The frangible ogive element 17 has a frangible link 17*a*, in the form of an aluminium thread, which is fastened to the locking ring 16. The frangible ogive element receives the expulsion charge 18 and fuze 19. Upon operation of the fuze 19, the expulsion charge 18 builds up pressure within the frangible ogive element and at the bursting pressure the thread 13 shears and the illumination payload apparatus 10 is expelled from the aft of the main body 24.

The illumination payload apparatus 10 is a modular illumination unit, which slides into the payload cavity 15.

Upon operation of the fuze 19, the expulsion charge 18 builds up pressure within the frangible ogive element 17 and at the bursting pressure the thread 13 on the tail unit shears and the illumination payload apparatus 10 is expelled from the aft of the main body 24. The expulsion charge may cause a delay composition 11 to ignite the illumination composition 29.

During a blind event, the shell 20 would not function as detailed above, and would hit the ground, wherein the frangible link 17*a* would be caused to fail, such that if fuze 19 did erroneously function, that the expulsion charge 18 would be at least partially vented and would not cause the illumination payload apparatus 25 to be expelled from the shell 20.

Figure 4:
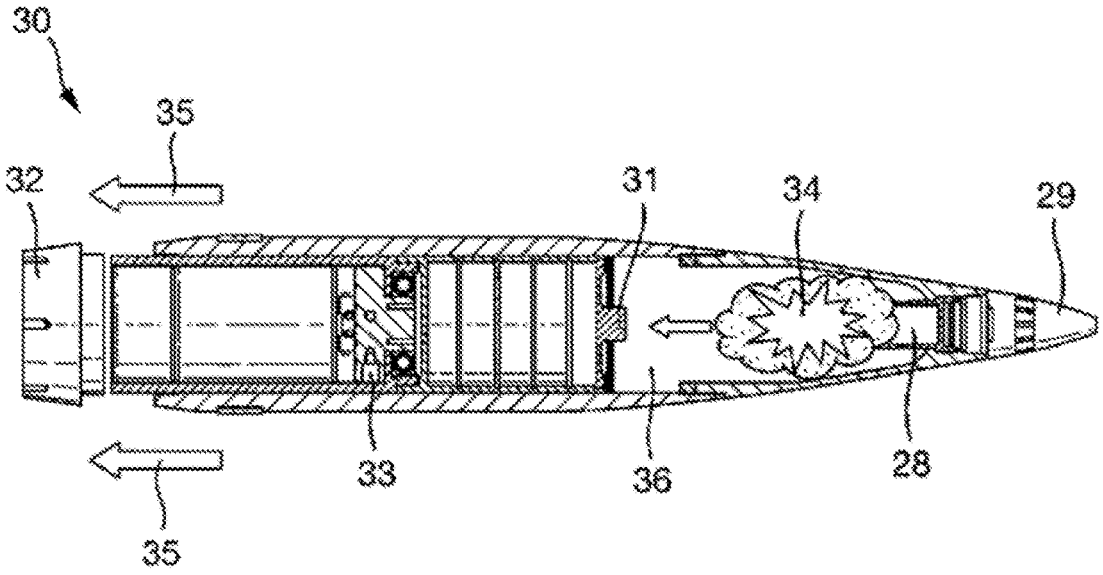
FIG. 4 shows a cross-section of an illumination shell.

FIG. 4 shows a cross section of an illumination shell 30, where the fuze 29 has caused the expulsion charge 28 to function with an energetic output 34, which causes ignition of delay igniter 31 and concomitantly shears the tail unit 32 causing ejection of the payload 33 and tail unit 32, in a rearwards direction 35, exiting the payload cavity 36.

FIG. 5*a* shows the initial deployment of the payload device 43. The shearable tail unit 46 has a considerable mass, is attached with a drogue tether 45 to the drogue parachute 47, such that as the tail unit 46 moves away from the shell (not shown), it causes the drogue parachute 47 to be pulled out of the payload apparatus 43 and deployed. The primary function of the drogue parachute is to cause rapid deceleration of the apparatus 43. The apparatus 43 is clear of the shell, and the delay igniter 41 is already activated with a controlled burn ready to ignite the illumination composition 42. The tail unit 46 has considerable momentum, and will be expected to continue its trajectory similar to that of the final safe zone of the empty shell.

The drogue parachute 47 when it deploys acts upon the carrier tether 48 to remove the main parachute carrier 50, which contains the main parachute 51 (inside), from within the payload apparatus 43. The carrier 50 and main parachute are attached by a tether arrangement 49 to the parachute delay device 44 retained within the apparatus 43.

FIG. 5*b* shows one arrangement for the release sequence in the parachute delay device 44 for the tether arrangement 49. The drogue parachute 47 is tethered by the carrier tether 48 which at its distil end connects to the releasable engagement device 60 which forms part of the parachute delay device 44. The carrier tether 48 is also operably attached to the main parachute carrier 50.

The drogue parachute 47 acts upon the carrier tether 48, which in turn acts upon the main carrier 50, via the attachment means 58 and concomitantly applies tension to the activator tether 56. The activator tether 56 in this arrangement is already under tension compared to the carrier tether 48, such that upon a selected force being applied the activator tether acts upon the activator 53 causing deactivation of the engagement device 60, thereby releasing the carrier tether from the delay device 44. The carrier tether remains operably linked by attachment means 58 to the main parachute carrier 58, and as the drogue parachute 47 applies further tension it removes the carrier 50 from around the main parachute 51 encased therein. The main parachute 51 remains tethered by payload tether 57 to the delay device 44.

FIG. 6 shows the drogue parachute 64 attached to the main parachute carrier 66 by the carrier tether 65. The drogue parachute 64 is then discarded. The main parachute 63 remains attached to the payload apparatus 61, by means of the payload tether 67, and the illumination composition 62 starts to burn.

FIG. 7, shows the controlled descent 70 of the illumination payload apparatus 71, under the control of the main parachute 74. The device during its descent illuminates 72 the target area of interest, whilst ensuring that the payload apparatus 71 remains intact and under the control of the main parachute, such that it mitigates against collateral damage.

The invention claimed is:

1. An illumination munition comprising a shearable tail unit, a main body which comprises a payload cavity for receiving an illumination payload apparatus, a fuze, an ogive element located between said main body and the fuze, and an explosive train operably connected to said fuze, wherein the illumination payload apparatus comprises an illumination composition, a drogue parachute and a main parachute, wherein the main parachute is tethered by a tether arrangement to the illumination payload apparatus, such that after deployment of said main parachute only the illumination payload apparatus descends under the control of said main parachute.

2. A munition according to claim 1, wherein drogue parachute is tethered by a drogue tether to the tail unit, such that upon shearing of the tail unit causes deployment of the drogue parachute.

3. A munition according to claim 1, wherein the drogue parachute is tethered by a carrier tether to a main parachute carrier and extending therethrough to a parachute delay device, wherein said carrier comprises said main parachute therein.

4. A munition according to claim 3, wherein the parachute delay device comprises the payload tether for the main parachute, a releasable engagement device to releasably receive the drogue tether, an activator which is tethered by an activator tether to the drogue tether, wherein upon activation of said activator causes release of the drogue tether.

5. A munition according to claim 1, wherein an expulsion charge operably connected to the explosive train causes ignition of an illumination delay ignitor which is operably linked to the illumination composition.

6. A munition according to claim 1, wherein the main body comprises a first threaded portion manufactured from a first material, and the tail unit comprises a second threaded portion manufactured from second material, wherein the second material has a lower hardness value than the first material.

7. A munition according to claim 6, wherein the first material is selected from a steel alloy and the second material is selected from aluminium or alloy thereof.

8. A munition according to claim 1, wherein the main parachute is a closed arm cruciform parachute.

9. A munition according to claim 1, wherein the illumination composition is at least one consolidated pellet.

10. A munition according to claim 1, wherein the ogive element is a frangible ogive element.

11. A munition according to claim 1, further comprising a locking ring located between the main body and the ogive element, to retain said illumination payload apparatus within the payload cavity, wherein the payload cavity has substantially parallel walls, which extend from the intersection of the tail unit to the locking ring.

12. A munition according to claim 1, wherein the illumination payload apparatus is capable of being dispensed rearwardly from the main body, upon shearing a shearable thread.

13. A method of dispensing an illumination payload apparatus from a munition according to claim 1, wherein the explosive train is operatively coupled to an expulsion charge, and said illumination payload apparatus is tethered to the shearable tail unit by a shearable thread, the method comprising causing initiation of the expulsion charge, which causes ignition of illumination delay igniter and shearing of the shearable thread, such that said illumination payload apparatus is caused to be pushed rearwardly from said shell, to disperse said illumination payload apparatus.

14. An illumination munition comprising:

a shearable tail unit;

a main body which comprises a payload cavity for receiving an illumination payload apparatus, wherein the illumination payload apparatus comprises an illumination composition, a drogue parachute and a main parachute, wherein the main parachute is tethered by a tether arrangement to the payload apparatus, such that after deployment of said main parachute said payload apparatus descends under the control of said main parachute;

a fuze operatively coupled to an expulsion charge;

a frangible ogive element located between said main body and the fuze; and a locking ring located between the main body and the frangible ogive element, to retain said illumination payload apparatus within the payload cavity.

15. A munition according to claim 14, wherein drogue parachute is tethered by a drogue tether to the tail unit, such that upon shearing of the tail unit causes deployment of the drogue parachute.

16. A munition according to claim 14, wherein the drogue parachute is tethered by a carrier tether to a main parachute carrier and extending therethrough to a parachute delay device, wherein said carrier comprises said main parachute therein, wherein the parachute delay device comprises the payload tether for the main parachute, a releasable engagement device to releasably receive the drogue tether, an activator which is tethered by an activator tether to the drogue tether, wherein upon activation of said activator causes release of the drogue tether.

17. A munition according to claim 14, wherein the expulsion charge causes ignition of an illumination delay ignitor which is operably linked to the illumination composition.

18. A munition according to claim 14, wherein the main parachute is a closed arm cruciform parachute.

19. A munition according to claim 14, wherein the illumination composition is at least one consolidated pellet.

20. A munition according to claim 14, wherein the illumination payload apparatus is capable of being dispensed rearwardly from the main body, in response to the expulsion charge being stimulated.

* * * * *